US010124499B2

(12) United States Patent
Bozikis et al.

(10) Patent No.: US 10,124,499 B2
(45) Date of Patent: Nov. 13, 2018

(54) RAZOR HEAD WITH IMPROVED GUARD BAR

(71) Applicant: BIC-VIOLEX SA, Anixi, Attiki (GR)

(72) Inventors: Ioannis Bozikis, Koukaki-Athens (GR); Athanasia Kontovaiou, Acharnes (GR)

(73) Assignee: BIC VIOLEX S.A., Anixi (GR)

( * ) Notice: Subject to any disclaimer, the term of this patent is extended or adjusted under 35 U.S.C. 154(b) by 0 days.

(21) Appl. No.: 15/035,230

(22) PCT Filed: Nov. 8, 2013

(86) PCT No.: PCT/EP2013/073432
§ 371 (c)(1),
(2) Date: May 7, 2016

(87) PCT Pub. No.: WO2015/067321
PCT Pub. Date: May 14, 2015

(65) Prior Publication Data
US 2016/0263756 A1 Sep. 15, 2016

(51) Int. Cl.
*B26B 21/40* (2006.01)

(52) U.S. Cl.
CPC ..... *B26B 21/4018* (2013.01)

(58) Field of Classification Search
CPC ..... B26B 21/4012; B26B 21/4018; B26B 21/4025; B26B 21/4031; B26B 21/443
USPC ..... 30/77, 50, 81; D28/46, 47
See application file for complete search history.

(56) References Cited

U.S. PATENT DOCUMENTS

| | | | | | |
|---|---|---|---|---|---|
| 2,472,807 | A * | 6/1949 | Clark | B26B 21/18 | 30/70 |
| D343,254 | S * | 1/1994 | Miller | D28/47 | |
| D343,255 | S * | 1/1994 | Miller | D28/47 | |
| 5,590,468 | A * | 1/1997 | Prochaska | B26B 21/22 | 30/41 |
| D403,811 | S * | 1/1999 | Brown | D28/47 | |
| 6,167,625 | B1 * | 1/2001 | King | B26B 21/4018 | 30/34.2 |
| 6,550,141 | B1 * | 4/2003 | Rivers | B26B 21/4006 | 30/346.57 |
| D527,491 | S * | 8/2006 | Wonderley | D28/47 | |
| D556,378 | S * | 11/2007 | Watson | D28/47 | |
| D587,404 | S * | 2/2009 | Wonderley | D28/47 | |

(Continued)

FOREIGN PATENT DOCUMENTS

| | | |
|---|---|---|
| EP | 2 601 020 B1 | 12/2014 |
| EP | 2 857 159 A1 | 4/2015 |

(Continued)

OTHER PUBLICATIONS

International Search Report of PCT/EP2013/073432 dated Jul. 7, 2014.

*Primary Examiner* — Laura M Lee
(74) *Attorney, Agent, or Firm* — Polsinelli PC

(57) ABSTRACT

A razor head is provided that includes a main frame member, at least one blade member mounted on the main frame member, having a blade edge extending along a transversal axis, and a guard bar having a plurality of grooves extending along a longitudinal axis. Each groove includes a deep section located next to the groove front end, a shallow section located next to the groove rear end, and a sloped section connecting the deep section to the shallow section.

19 Claims, 6 Drawing Sheets

(56) References Cited

U.S. PATENT DOCUMENTS

| | | | | |
|---|---|---|---|---|
| D588,309 | S * | 3/2009 | Wonderley | D28/47 |
| D622,904 | S * | 8/2010 | Kinard | D28/47 |
| D633,254 | S * | 2/2011 | Witkus | D28/47 |
| 8,061,039 | B2 * | 11/2011 | Kwiecien | B26B 21/443 30/41 |
| 8,079,147 | B2 * | 12/2011 | Wonderley | B26B 21/225 30/47 |
| 9,415,522 | B2 * | 8/2016 | Oglesby | B26B 21/4031 |
| 2003/0217470 | A1 * | 11/2003 | Follo | B26B 21/4018 30/81 |
| 2004/0025350 | A1 * | 2/2004 | Richard | B26B 21/227 30/50 |
| 2005/0246899 | A1 * | 11/2005 | Wain | B26B 21/227 30/49 |
| 2009/0071006 | A1 * | 3/2009 | Bruno | B26B 21/44 30/34.2 |
| 2010/0058595 | A1 | 3/2010 | Walker et al. | |
| 2010/0293789 | A1 * | 11/2010 | Kwiecien | B26B 21/443 30/34.05 |
| 2011/0094108 | A1 | 4/2011 | Wain | |

FOREIGN PATENT DOCUMENTS

| | | | |
|---|---|---|---|
| WO | WO 2006/108175 | A1 | 10/2006 |
| WO | WO 2010/039749 | A1 | 4/2010 |
| WO | WO 2010/065366 | A1 | 6/2010 |
| WO | WO 2010/132227 | A1 | 11/2010 |
| WO | WO 2010/144638 | A1 | 12/2010 |
| WO | WO 2011/062760 | A1 | 5/2011 |
| WO | WO 2012/018892 | A1 | 2/2012 |
| WO | WO 2015/063773 | A1 | 5/2015 |

* cited by examiner

RAZOR HEAD WITH IMPROVED GUARD BAR

This application is a national stage application of International Application No. PCT/EP2013/073432, filed on Nov. 8, 2013, the entire contents of which is incorporated herein by reference.

FIELD OF INVENTION

The embodiments of the present invention relate to a wet razor with improved shaving properties. The embodiments of the present invention particularly relate to a shaving razor head provided with an improved groove structure for improving the passage of the hairs to the blades.

BACKGROUND OF THE INVENTION

Razor heads having a guard with grooves are known, for instance from WO 2012/018892 which describes such a guard having a plurality of grooves extending perpendicular to the blade edges. However, such guard bars do not provide an even spreading of the shaving aid and a proper alignment of hairs during the shaving process and thus the shaving properties of such razor heads are not optimal.

One objective of the present invention is to improve the shaving properties of such a razor head.

SUMMARY OF THE INVENTION

To this aim, according to the present invention, such a razor head comprises:

a main frame member extending along a transversal axis, at least one blade member mounted on the main frame member, having a blade edge extending along the transversal axis, and a guard having a plurality of grooves, each groove having a bottom surface that extends along a longitudinal axis perpendicular to the transversal axis from a groove front end up to a groove rear end in proximity of the blade edge, wherein each groove comprises a deep section located next to the groove front end, a shallow section located next to the groove rear end and a sloped section connecting the deep section to the shallow section.

In a specific embodiment of the present invention, the guard bar is located forward of the blade edge.

In a specific embodiment of the present invention, the grooves are separated one from the other by a plurality of ribs having top surfaces, a rib defining a groove depth measured along a vertical axis, perpendicular to the longitudinal and transversal axis, between a bottom surface of a groove and a top surface of a rib.

In a specific embodiment of the present invention, the sloped section of each groove extends from a sloped section front end up to a sloped section rear end, the sloped section front end is connected to the deep section, the sloped section rear end is connected to the shallow section, and a groove depth decreases from the sloped section front end to the sloped section rear end.

In a specific embodiment of the present invention, a maximum angle of inclination between a bottom surface and a top surface of a sloped section is less than forty-five degrees, preferably less than thirty-five degrees.

In a specific embodiment of the present invention, a minimum angle of inclination between a bottom surface and a top surface of a sloped section is greater than ten degrees, preferably greater than twenty degrees.

In a specific embodiment of the present invention, a groove depth is substantially constant along the shallow section.

In a specific embodiment of the present invention, a groove depth is substantially constant along the deep section.

In a specific embodiment of the present invention, a bottom transversal shape of the bottom surface of each groove comprises a bottom rectilinear portion substantially parallel the transversal axis.

In a specific embodiment of the present invention, a bottom surface width of said bottom rectilinear portion, measured along the transversal axis, is at least half of a groove width, preferably at least seventy-five percent of a groove width, more preferably at least ninety percent of a groove width.

In a specific embodiment of the present invention, the sloped section is respectively connected to the deep section and to the shallow section by two rounded portions.

In a specific embodiment of the present invention, each groove has two substantially parallel vertical walls extending along a vertical axis perpendicular to the longitudinal and transversal axis.

In a specific embodiment of the present invention, each rib defines two substantially parallel vertical walls extending along a vertical axis perpendicular to the longitudinal and transversal axis.

In a specific embodiment of the present invention, the top surface of each rib comprises a top planar portion being substantially planar extending from a rib front end, located next to a groove front end, up to a rib rear end, located next to a groove rear end.

In a specific embodiment of the present invention, a top transversal shape of the top surface of each rib comprises a top rectilinear portion parallel the transversal axis.

In a specific embodiment of the present invention, a top surface width of the top rectilinear portion, measured along the transversal axis, is less than ninety percent of a rib width, preferably less than seventy-five percent of a rib width, more preferably less than half of a rib width.

In a specific embodiment of the present invention, each groove extends from a front end of the guard bar up to a rear end of the guard bar.

In a specific embodiment of the present invention, the guard bar comprises at least ten grooves, preferably at least fifteen grooves.

In a specific embodiment of the present invention, a groove width, measured along the transversal axis, is from 0.1 mm to 1.5 mm, preferably from 0.5 mm to 1 mm, more preferably about 0.8 mm.

In a specific embodiment of the present invention, a groove pitch, measured along the transversal axis, is from 0.5 mm to 3 mm, preferably from 1 mm to 2 mm, more preferably about 1.7 mm.

In a specific embodiment of the present invention, a groove depth along the deep section is from 0.1 mm to 1.5 mm, preferably from 0.5 mm to 1 mm, more preferably about 0.7 mm.

In a specific embodiment of the present invention, a groove depth along the shallow section is from 0.1 mm to 1.5 mm, preferably from 0.1 mm to 0.5 mm, more preferably about 0.3 mm.

In a specific embodiment of the present invention, a rib width, measured along the transversal axis, is from 0.1 mm to 1.5 mm, preferably from 0.5 mm to 1 mm, more preferably about 0.8 mm.

In a specific embodiment of the present invention, the shallow section is a zero depth section.

In a specific embodiment of the present invention, a groove depth at a rear end of the sloped section is zero.

In a specific embodiment of the present invention, the guard bar is integrally formed with the frame member.

In a specific embodiment of the present invention, the guard bar is made of plastic.

In a specific embodiment of the present invention, the guard bar is made of metal.

In a specific embodiment of the present invention, the guard bar is made of thermoplastic elastomer.

Another object of the present invention is a wet razor comprising a handle and a razor head described above, the razor head being borne by the handle.

With these features, the shaving aid placed on the skin before shaving is being spread more evenly when the stroke occurs because of the shape of the grooves provided on the guard bar. The ribs of the guard bar help the user maintain the control of the strokes during shaving by grouping the hair and guiding them to the cutting edge of the blades thereby improving hair alignment and comb performance. The shaving process is also more controlled by the user, improving the comfort of the shaving. Due to the fact that the shaving aid is evenly distributed on the face, the friction forces are better distributed on the user's skin for a more consistent shave. Moreover, by avoiding bending the hair, the pulling of hair during cutting is reduced providing a more comfortable shave. The rinsability of the shaver is also increased due to the design of the sloped section of the grooves which facilitate the shaving aid flow thus leaving free space for water flow.

BRIEF DESCRIPTION OF THE DRAWINGS

Other characteristics and advantages of the present invention will readily appear from the following description of one of its embodiments, provided as a non-limitative example, and of the accompanying drawings.

On different Figures, the same reference signs designate like or similar elements.

DETAILED DESCRIPTION

Figure 1:
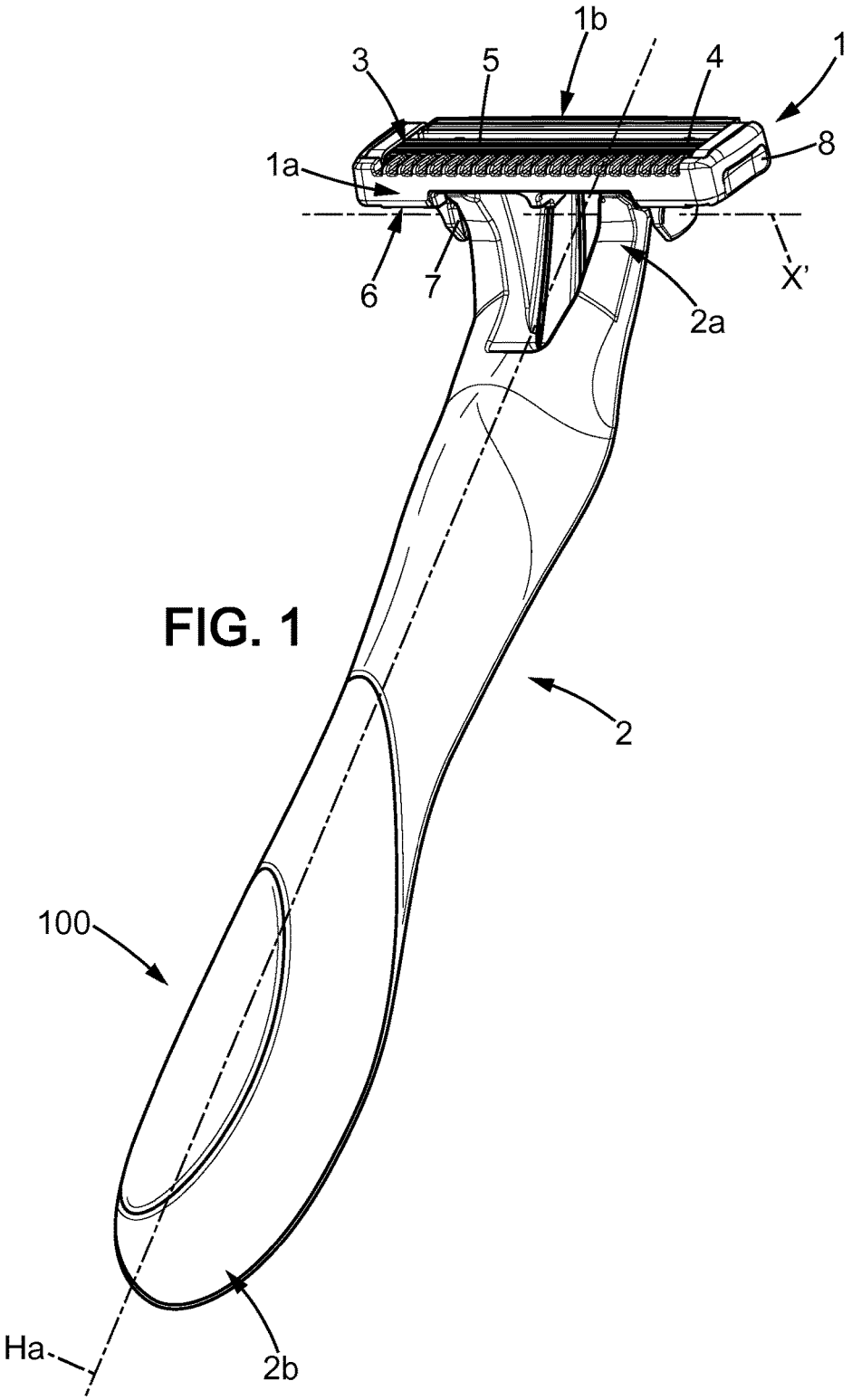
FIG. 1 shows a perspective view of a wet razor comprising a handle and a razor head according to the invention.

FIG. 1 shows a wet razor 100 including a razor head 1 and a handle 2.

The razor head 1 is intended to be borne by the handle 2 extending in a handle direction Ha between a proximal portion 2*b* and a distal portion 2*a* bearing the shaving head 1. The handle direction Ha may be curved or include one or several straight portions.

The razor head 1 includes a top face 3 defining a shaving window 4, and equipped with one or several blade members 5 and a bottom face 6 which is to be connected to the distal portion 2*a* of the handle 2 by a connection mechanism 7.

On the example shown on the Figures, there are three blade members 5. However, the razor head 1 may also use more or less blade members 5.

The blade members 5 each have a blade edge 5*a* extending along a transversal axis X.

Figure 2:
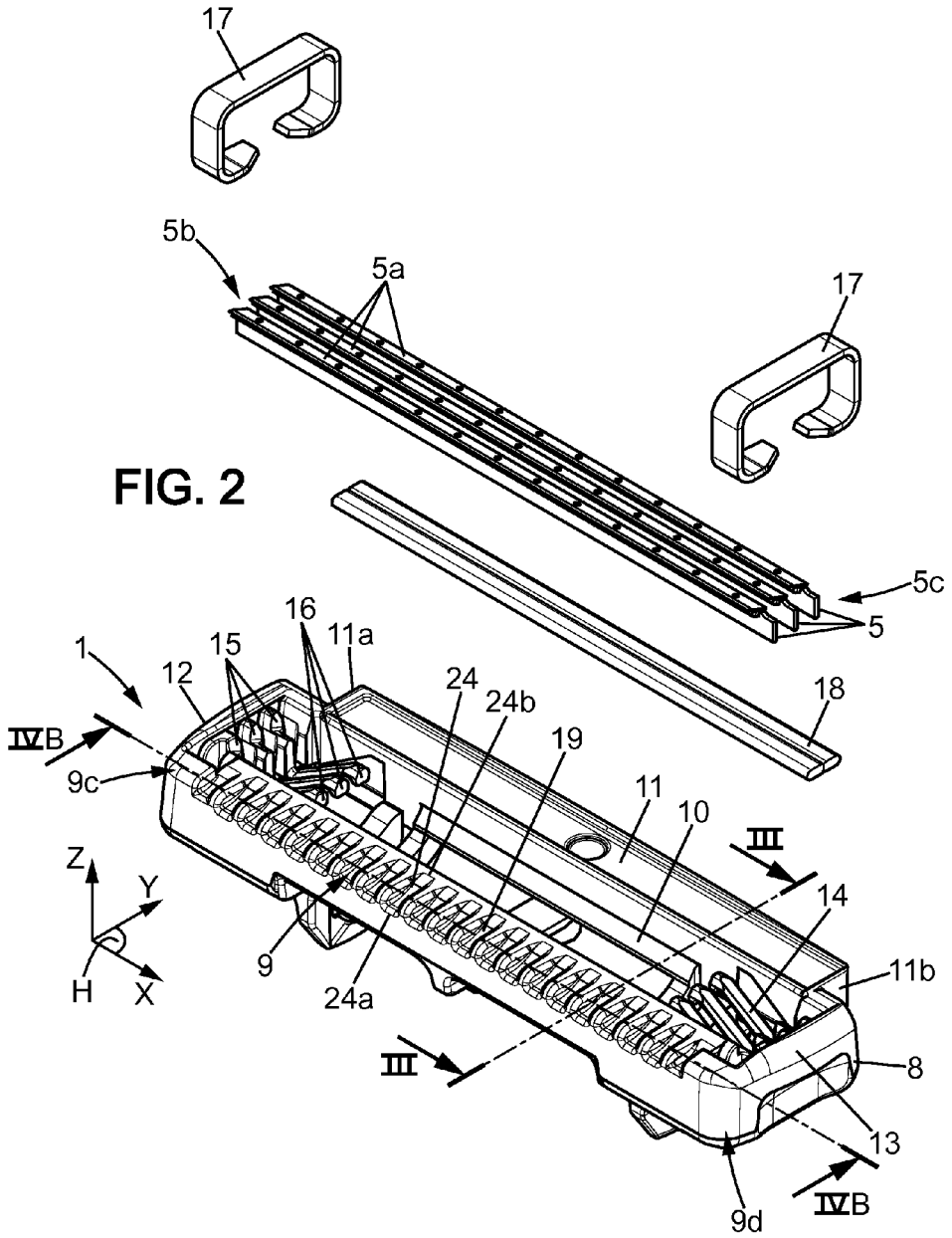
FIG. 2 is an exploded perspective view of the razor head of FIG. 1.

The blade members 5 extend along the transversal axis X from a first transversal blade end 5*b*, to a second transversal blade end 5*c*, as shown on FIG. 2.

The transversal axis X further defines a longitudinal axis Y of the razor head 1 which is perpendicular to the transversal axis X, and a vertical axis Z of the razor head 1 which is perpendicular to the transversal axis X and to the longitudinal axis Y.

The longitudinal axis Y defines a front end 1*a* and a rear end 1*b* of the razor head 1, the blade edges 5*a* being oriented toward the front end 1*a* of the razor head 1.

Unless it is expressly mentioned otherwise, the terms "front", "frontward", "rear" and "rearward" are thus to be understood as referring to the front and the back of the razor head 1, a rear-to-front direction, or direction of shaving, extending along the longitudinal axis Y, from the rear end 1*b* of the razor head 1 toward the front end 1*a* of the razor head 1.

The connection mechanism 7 may enable the head 1 to pivot relative to a pivot axis X' which is substantially parallel to the transversal axis X. The connection mechanism 7 may further be configured to selectively release the razor head 1 for the purpose of exchanging razor heads.

One particular example of connection mechanism 7 usable in the present invention is described in document WO-A-2006/027018, which is hereby incorporated by reference in its entirety for all purposes.

Figure 3:
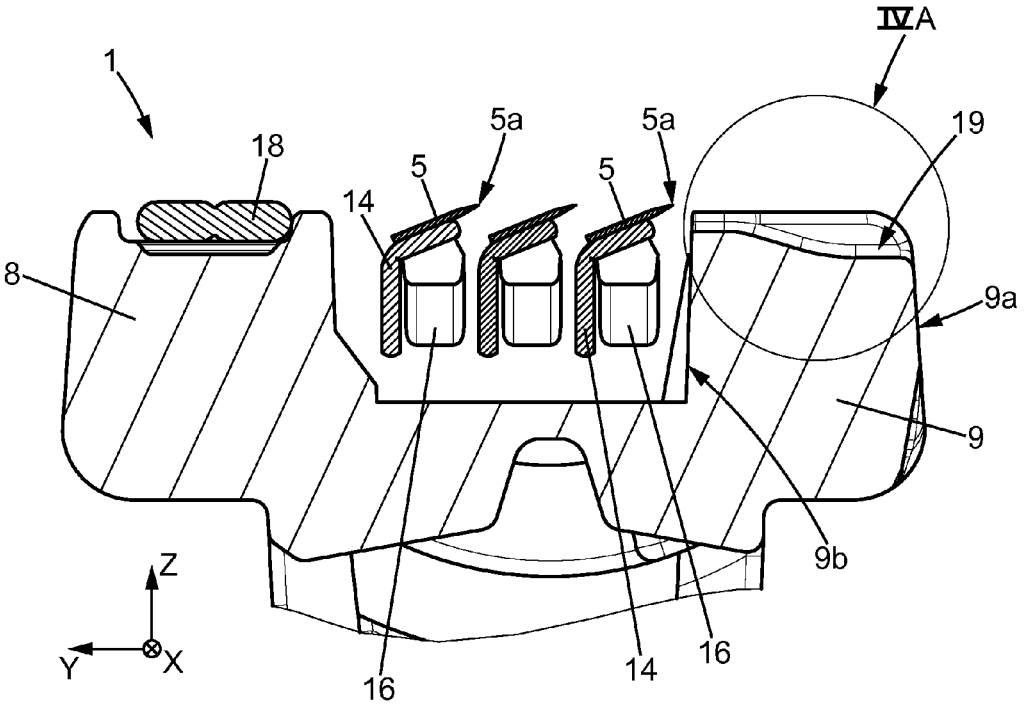
FIG. 3 shows a schematic sectional view along the axis referenced III represented on FIG. 2, of a razor head according to the invention.

As depicted on FIGS. 1, 2 and 3, the razor head 1 includes a main frame member 8 connected to the handle 2 by the connection mechanism 7 and having:

a guard bar 9 having a front end 9*a* and a rear end 9*b*, the guard bar 9 extending parallel to the transversal axis X from a first transversal end 9*c* to a second transversal end 9*d*, a blade receiving section 10 located rearward of the guard 9 in the direction of shaving, a rear portion 11 extending parallel to the pivot axis X', from a first transversal end 11*a* to a second transversal end 11*b*, located rearward of the blade receiving section 10 in the direction of shaving, and a first side portion 12 and a second side portion 13, the first side portion 12 joining the first transversal ends 9*a*, 11*a* of the guard bar 9 and of the rear portion 11 together, the second side portion 13 joining the second transversal ends 9*b*, 11*b* of the guard bar 9 and of the rear portion 11 together.

The blade members 5 of such a wet shaver 100 are usually not driven by a motor relative to the main frame member 8.

Preferably, the main frame member 8 is in one-piece. The guard bar 9 may thus be integrally formed with the frame member 8. The guard bar 9 and the main frame member 8 can be made solely of synthetic materials or plastic, i.e. thermoplastic materials (polystyrene or ABS, for example) and elastomeric materials.

The razor head 1 may be produced by co-injection, in particular if the guard bar 9 is made in an elastomer, for instance a thermoplastic elastomer. The razor head 1 may be produced by single injection, in particular if the guard bar 9 is made in plastic.

In an alternate embodiment of the present invention, the guard bar 9 may be separated from the frame member 8. The guard bar 9 and the frame member 8 may thus forms separate entities.

In this alternate embodiment of the present invention, the guard bar 9 may be made in synthetic materials or plastic but may also be made in metal, wood or another material, in particular a material able to enhance the shaving properties of the guard bar. In this alternate embodiment of the present invention, the razor head 1 may be produced by a process different from co-injection and single injection.

The blade members 5 may be made from bent sheet metal, or, preferably, they may be straight and supported by blade supports 14. The blade members 5 and/or the blade supports 14 are then accommodated in seats 15 provided in the side portions 12, 13.

Moreover, the blade members 5 may for instance be placed movably in the shaving head 1. The side portions 12,13 of the shaving head 1 may be provided with elastic fingers 16, extending towards the insides of the cartridge frame or frame member, in a direction parallel to the blade members 5, in particular substantially along the transversal axis X, and movably supporting the blade members 5.

The blade members 5 may be held in the blade receiving section 10 of the main frame member 8 by a pair of bent metal strips 17, which encircle the first and second transversal blade ends 5*b*, 5*c* and thus hold them in place.

On the rear portion 11, lying generally in a plane defined by the blade edges, a shaving aid 18 may be provided.

In other embodiments of the present invention, the blade members 5 may be fixed.

As shown in FIGS. 1, 2, 3, 4A and 4B, the guard bar 9 extends parallel to the transversal axis X. It includes a plurality of grooves 19, each groove extending transverse to the transversal axis X, and thus substantially along the longitudinal direction Y.

The guard bar 9 may include at least ten grooves 19, preferably at least fifteen grooves 19.

Each groove 19 has a bottom surface 20 that extends longitudinally from a groove front end 19*a* to a groove rear end 19*b* close to the blade edge 5*a*.

Each groove 19 may extend from the front end 9*a* of the guard bar 9 up to the rear end 9*b* of the guard bar 9.

In another embodiment of the present invention, each groove 19 may extend from the front end 9*a* of the guard bar 9 but not up to the rear end 9*b* of the guard bar 9. A spacing 19*c* may thus exist between the groove rear end 19*b* and the rear end 9*b* of the guard bar 9.

Each groove 19 includes a deep section 21 located next to the groove front end 19*a* and a sloped section 23.

Each groove 19 may further include a shallow section 22 located next to the groove rear end 19*b*, the sloped section 23 connecting the deep section 21 to the shallow section 22.

The bottom surface 20 may include a deep section bottom surface 20*a*, a shallow section bottom surface 20*b* and a sloped section bottom surface 20*c*.

The sloped section 23 extends from a sloped section front end 23*a* up to a sloped section rear end 23*b*.

The sloped section front end 23*a* may be connected to the deep section 21 while the sloped section rear end 23*b* may be connected to the shallow section 22.

Figure 4A:
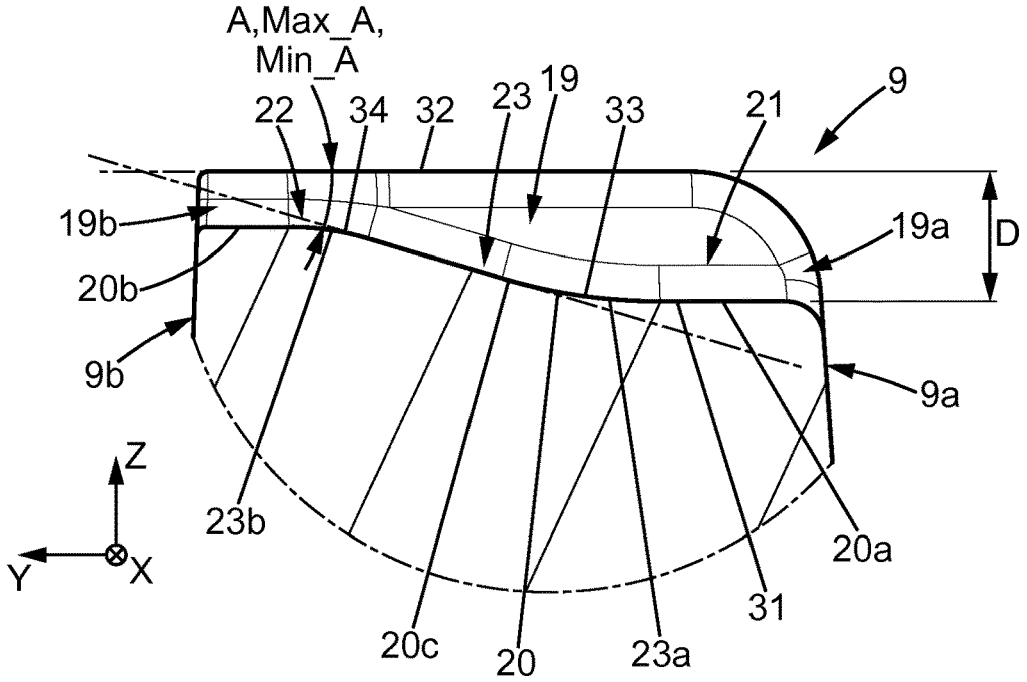
FIG. 4A is a detailed schematic sectional along the axis referenced III represented on FIG. 2, of a guard bar of a razor head according to a first embodiment of the present invention.
Figure 4B:
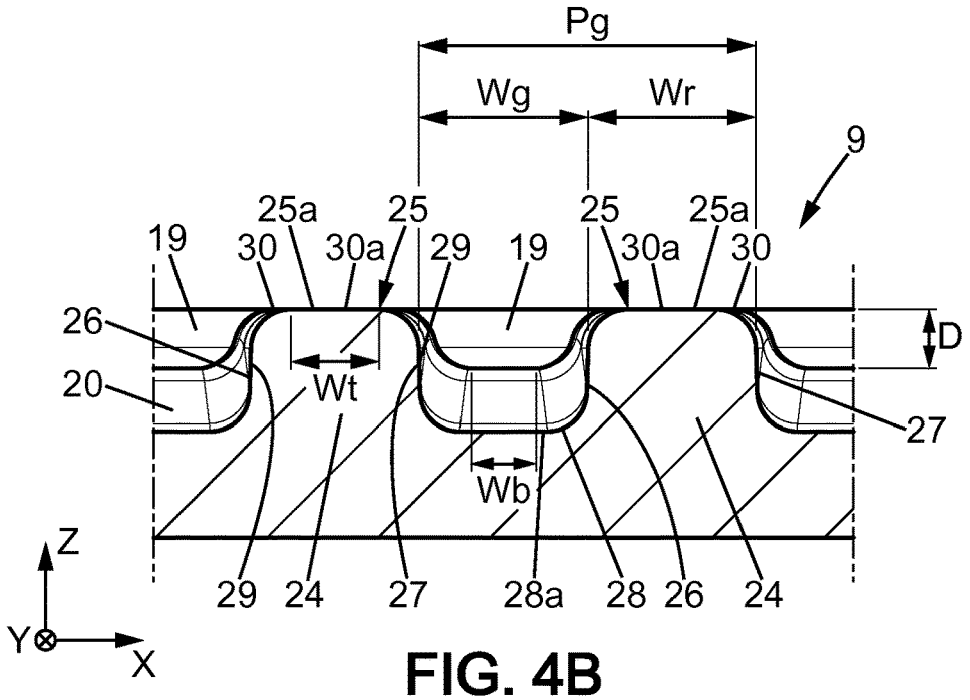
FIG. 4B is another detailed schematic sectional along the axis referenced IV represented on FIG. 2, of a guard bar of a razor head according to a first embodiment of the invention.

As represented in FIGS. 2 and 4B, the grooves 19 may be separated one from the other by a plurality of ribs 24 defining top surfaces 25.

Each rib 24 may extend from the rib front end 24*a* up to the rib rear end 24*b*.

The rib front end 24*a* may be located next to a groove front end 19*a*.

The rib rear end 24*b* may further be located next to a rear groove rear end 19*b*.

Each rib 24 may define a first vertical wall 26 and a second vertical wall 27.

The first vertical wall 26 and the second vertical wall 27 may be substantially parallel together.

The first vertical wall 26 and the second vertical wall 27 extend substantially along the longitudinal direction Y.

Figure 5A:
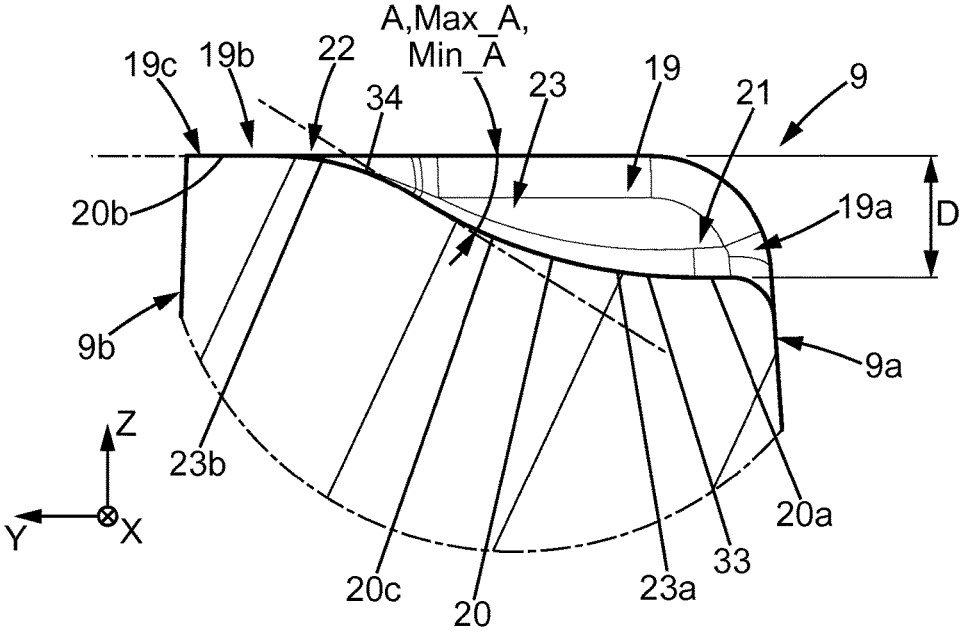
FIG. 5A is a detailed schematic sectional along the axis referenced III represented on FIG. 2, of a guard bar of a razor head according to a second embodiment of the present invention.
Figure 5B:
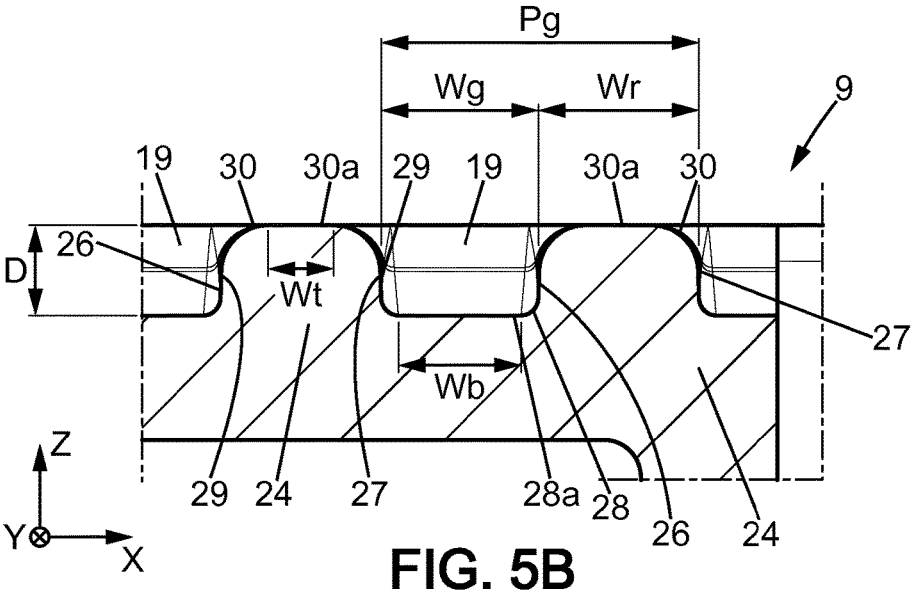
FIG. 5B is another detailed schematic sectional along the axis referenced IV represented on FIG. 2, of a guard bar of a razor head according to a second embodiment of the present invention.

In the embodiments of FIGS. 4B and 5B, the first vertical wall 26 and the second vertical wall 27 may extend along the vertical axis Z and substantially perpendicular to the transversal axis X.

Figure 6:
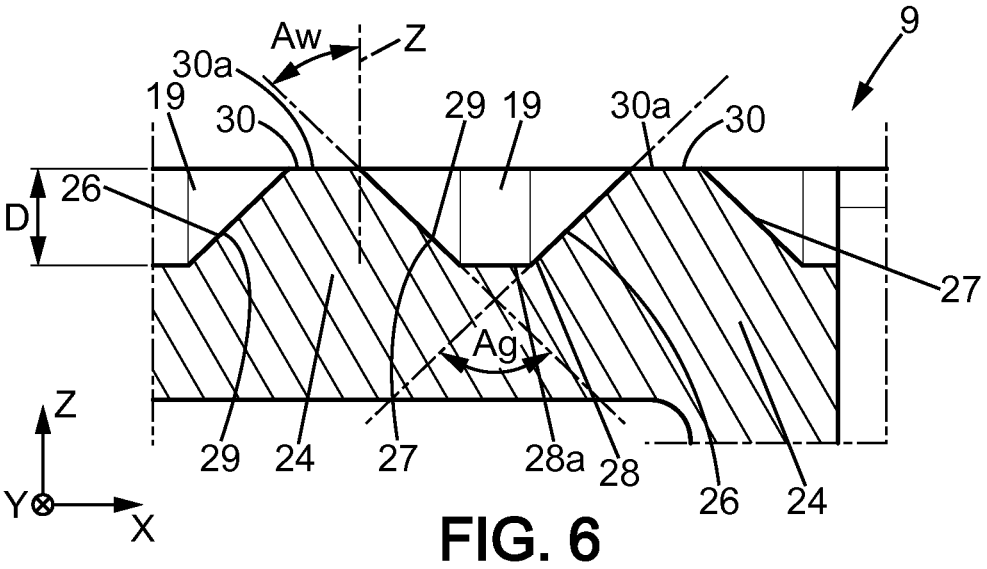
FIG. 6 is a detailed schematic sectional along the axis referenced IV represented on FIG. 2, of a guard bar of a razor head according to a third embodiment of the present invention.

In a third embodiment of the present invention, illustrated on FIG. 6, the first vertical wall 26 and the second vertical wall 27 may show a wall angle Aw with the vertical axis Z. The wall angle Aw may for instance be between one and twenty five degrees.

In the third embodiment of FIG. 6, the first vertical wall 26 and the second vertical wall 27 may show a groove wall angle Ag between them. The groove wall angle Ag may for instance be between one and forty five degrees.

The term "vertical" in "first vertical wall" and "second vertical wall" should be understood as meaning that the "first vertical wall" and "second vertical wall" extend in particular along the vertical axis Z and may show a non-zero wall angle Aw with the vertical axis. In particular, the term "vertical" in "first vertical wall" and "second vertical wall" should not be understood as meaning that the "first vertical wall" and/or the "second vertical wall" are strictly vertical walls.

FIG. 4B is a cross-section view, perpendicular to the longitudinal axis Y, of the bottom surface 20 of each groove 19 showing a bottom transversal shape 28, being a transversal shape of the bottom surface 20 of each groove 19, a vertical transversal shape 29, being a transversal shape of the vertical walls 26, 27 of each groove 19, and a top transversal shape 30, being a transversal shape of the top surface 25 of each groove 24.

More precisely, each groove 19 includes two substantially parallel vertical walls 26, 27. A first vertical wall 26 is defined by an adjacent rib 24 located next to the groove 19 in the direction of the first transversal end 9*a* of the guard bar 9 while a second vertical wall 27 is defined by another adjacent rib 24 located next to the groove 19 in the direction of the second transversal end 9*b* of the guard bar 9.

For each groove 19, the two vertical walls 26, 27 define a groove width Wg, the width being the distance separating the vertical walls 26, 27 as measured along the transversal axis X.

For each groove 19, the groove width Wg is substantially constant along the groove extension, i e. along the longitudinal axis Y.

The groove width Wg may be from 0.1 mm to 1.5 mm, preferably from 0.5 mm to 1 mm, more preferably about 0.8 mm.

Similarly, each rib 24 has a first vertical wall 26 and a second vertical wall 27 and for each rib 24, the two vertical walls 26, 27 define a rib width Wr, the width being the distance separating the vertical walls 26, 27 as measured along the transversal axis X.

The rib width Wr may be from 0.1 mm to 1.5 mm, preferably from 0.5 mm to 1 mm, more preferably about 0.8 mm.

A groove pitch Pg may be defined as the sum of the groove width Wg and the rib width Wr. Alternatively, the groove pitch Pg can be defined as the transversal periodicity of the grooves and ribs on the guard bar 9.

The groove pitch Pg may be from 0.5 mm to 3 mm, preferably from 1 mm to 2 mm, more preferably about 1.7 mm.

The bottom transversal shape 28 of the bottom surface 20 of each groove 19 may further include a bottom rectilinear portion 28*a* parallel the transversal axis X.

A bottom surface width Wb of the bottom rectilinear portion 28*a*, measured along the transversal axis X, is at least half of the groove width Wg, preferably at least seventy-five percent of the groove width Wg, more preferably at least ninety percent of the groove width Wg.

The top transversal shape 30 of the top surface 25 of each rib 24 may also include a top rectilinear portion 30*a* parallel the transversal axis X.

A top surface width Wt of the top rectilinear portion 30*a*, measured along the transversal axis X, is less than ninety percent of the rib width Wr, preferably less than seventy-five percent of the rib width Wr, more preferably less than half of the rib width Wr.

As seen on FIG. 4A, for each groove 19, a groove depth D may also be defined as the distance separating the bottom surface 20 of a groove 19 from the top surface 25 of a rib 24 adjacent to the groove 19, as measured along the vertical axis Z.

In particular, the groove depth D may be the distance separating the bottom rectilinear portion 28*a* of the bottom transversal shape 28 of the bottom surface 20 of a groove 19 from the top rectilinear portion 30*a* of the top transversal shape 30 of the top surface 25 of a rib 24 adjacent to the groove 19, as measured along the vertical axis Z.

The groove depth D may be substantially constant along the deep section 21.

The groove depth D along the deep section 21 may be from 0.1 mm to 1.5 mm, preferably from 0.5 mm to 1 mm, more preferably about 0.7 mm.

The groove depth D may also be substantially constant along the shallow section 22.

The groove depth D along the shallow section 22 may be from 0.1 mm to 1.5 mm, preferably from 0.1 mm to 0.5 mm, more preferably about 0.3 mm.

Along the sloped section 23, the groove depth D may decrease from the sloped section front end 23*a* to the sloped section rear end 23*b*.

In particular, the groove depth D may decrease regularly from the sloped section front end 23*a* to the sloped section rear end 23*b* and in particular not show any increase going from the sloped section front end 23*a* to the sloped section rear end 23*b*.

In a second embodiment of the present invention illustrated on FIGS. 5A and 5B, the shallow section 22 may be a zero depth section.

In at least one embodiment, the bottom surface 20 of the shallow section 22 may be continuously connected with the top surfaces 25 of the ribs 24 adjacent to the groove 19.

In particular, the bottom surface 20 of the shallow section 22 and the top surfaces 25 of the ribs 24 adjacent to the groove 19 may be located in the same horizontal plane H, perpendicular to the vertical axis Z.

In at least one embodiment, the groove depth D at the sloped section rear end 23*b* may be equal to zero.

The bottom surface 20 of each groove 19 may include a bottom planar portion 31 being a substantially planar portion of the bottom surface 20.

The bottom planar portion 31 may correspond to an extension along the longitudinal axis Y of the bottom rectilinear portion 28*a* of the bottom transversal shape 28 of the bottom surface 20 of each groove 19.

The bottom planar portion 31 may extend from the groove front end 19*a* up to the groove rear end 19*b*.

The top surface 25 of each rib 24 may include a top planar portion 32 being a substantially planar portion of the top surface 25.

The top planar portion 32 may correspond to an extension along the longitudinal axis Y of the top rectilinear portion 30*a* of the top transversal shape 30 of the top surface 25 of each rib 24.

The top planar portion 32 may extend from the rib front end 24*a* up to the rib rear end 24*b*.

As shown on FIGS. 4A and 5*a*, an angle of inclination A can be defined as an angle between the bottom surface 20, and in particular the sloped section bottom surface 20*c*, and the top surface 25 of the sloped section 20.

More precisely, the angle of inclination A may be an angle between the bottom planar portion 31 of the bottom surface 20 of a groove 19 and the top planar portion 32 of the top surface 25 of a rib 24 adjacent to the groove 19.

Alternatively, the angle of inclination A may be defined as an angle between the bottom surface 20, and in particular the sloped section bottom surface 20*c*, and a horizontal plane H perpendicular to the vertical axis Z.

A maximum angle of inclination Max_A being the highest value of the angle of inclination A along the sloped section 20 is less than eighty-five degrees, preferably less than forty-five degrees.

A minimum angle of inclination Min_A being the lowest value of the angle of inclination A along the sloped section 20 is greater than six degrees, preferably greater than ten degrees.

In the embodiments of FIGS. 5A and 5B, the sloped section 23 is connected to the deep section 21 by a first rounded portion 33.

The sloped section 23 may also be connected to the shallow section 22 by a second rounded portion 34.

In particular, a maximum radius Max_R of the first rounded portion 33 and/or the second rounded portion 34 may be greater than the groove depth D along the deep section 21.

The invention claimed is:

1. A razor head comprising:

a main frame member extending along a transversal axis, at least one blade member mounted on the main frame member, having a blade edge extending along the transversal axis, and a guard bar having a plurality of grooves, each of the plurality of grooves having a groove depth including a deep section located next to a groove front end, a shallow section located next to a groove rear end, and a sloped section connecting the deep section to the shallow section, the deep section including a deep section bottom surface, the shallow section including a shallow section bottom surface that is substantially parallel to the deep section bottom surface, and the sloped section including a sloped section bottom surface, the deep section bottom surface, the shallow section bottom surface, and the sloped section bottom surface defining a groove bottom surface that extends along a longitudinal axis perpendicular to the transversal axis from the groove front end up to the groove rear end in proximity to the blade edge, and wherein the deep section and the shallow section each have a substantially constant depth, respectively, along the deep section bottom surface and the shallow section bottom surface.

2. The razor head according to claim 1, wherein the guard bar is located forward of the blade edge.

3. The razor head according to claim 2, wherein the plurality of grooves are separated one from the other by a plurality of ribs having top surfaces, the plurality of ribs defining the groove depth measured along a vertical axis, perpendicular to the longitudinal axis and to the transversal axis, between the bottom surface of the plurality of grooves and a top surface of the plurality of ribs.

4. The razor head according to claim 2, wherein a bottom transversal shape of the bottom surface of each of the plurality of grooves includes a bottom rectilinear portion substantially parallel the transversal axis, and wherein a bottom surface width of the bottom rectilinear portion, measured along the transversal axis, is at least half of a groove width.

5. The razor head according to claim 1, wherein the plurality of grooves are separated one from the other by a plurality of ribs having top surfaces, the plurality of ribs defining the groove depth measured along a vertical axis, perpendicular to the longitudinal axis and to the transversal axis, between the bottom surface of the plurality of grooves and the top surface of the plurality of ribs.

6. The razor head according to claim 5, wherein the sloped section of each of the plurality of grooves extends from a sloped section front end up to a sloped section rear end, the sloped section front end is connected to the deep section, the sloped section rear end is connected to the shallow section, and the groove depth decreases from the sloped section front end to the sloped section rear end.

7. The razor head according to claim 6, wherein a maximum angle of inclination between a bottom surface and a top surface of the sloped section is less than forty-five degrees.

8. The razor head according to claim 5, wherein a maximum angle of inclination between the groove bottom surface and a top surface of the sloped section is less than forty-five degrees.

9. The razor head according to claim 5, wherein a minimum angle of inclination between the groove bottom surface and a top surface of the sloped section is greater than ten degrees.

10. The razor head according to claim 5, wherein each one of the plurality of ribs includes a rib width and the top surface of each of the plurality of ribs includes a top transversal shape having a top rectilinear portion parallel the transversal axis, and wherein the top surface defines a top surface width, the top rectilinear portion, being a portion of the top surface measured along the transversal axis, the top surface includes a width that is less than ninety percent of the rib width.

11. The razor head according to claim 5, wherein a bottom transversal shape of the bottom surface of each of the plurality of grooves includes a bottom rectilinear portion substantially parallel the transversal axis, and wherein a bottom surface width of the bottom rectilinear portion, measured along the transversal axis, is at least half of a groove width.

12. The razor head according to claim 5, wherein each one of the plurality of ribs comprises a rib width and the top surface of each of the plurality of ribs includes a top rectilinear portion parallel the transversal axis, and wherein the top surface defines a top surface width of the top rectilinear portion, being a portion of the top surface measured along the transversal axis, the top surface includes a width that is less than ninety percent of the rib width.

13. The razor head according to claim 1, wherein a bottom transversal shape of the bottom surface of each of the plurality of grooves includes a bottom rectilinear portion substantially parallel the transversal axis, and wherein a bottom surface width of the bottom rectilinear portion, measured along the transversal axis, is at least half of a groove width.

14. The razor head according to claim 1, wherein each of the plurality of grooves has two substantially parallel vertical walls extending along a vertical axis perpendicular to the longitudinal axis and to the transversal axis.

15. The razor head according to claim 1, wherein a groove width, measured along the transversal axis, is from 0.1 mm to 1.5 mm.

16. The razor head according to claim 5, wherein a groove depth along the deep section is from 0.1 mm to 1.5 mm.

17. The razor head according to claim 5, wherein a rib width, measured along the transversal axis, is from 0.1 mm to 1.5 mm.

18. The razor head according to claim 1, wherein the guard bar is integrally formed with the main frame member.

19. A wet razor comprising a handle and a razor head according to claim 1, the razor head being borne by the handle.

* * * * *